US007159393B2

(12) United States Patent
Blomquist et al.

(10) Patent No.: US 7,159,393 B2
(45) Date of Patent: Jan. 9, 2007

(54) DEVICE FOR EXHAUST GAS PURIFICATION

(75) Inventors: Micael Blomquist, Kvissleby (SE); Urban Ericson, Njurunda (SE)

(73) Assignee: STT Emtec AB, Sundsvall (SE)

( * ) Notice: Subject to any disclaimer, the term of this patent is extended or adjusted under 35 U.S.C. 154(b) by 0 days.

(21) Appl. No.: 10/497,793

(22) PCT Filed: Nov. 25, 2002

(86) PCT No.: PCT/SE02/02157

§ 371 (c)(1),
(2), (4) Date: Jan. 4, 2005

(87) PCT Pub. No.: WO03/067044

PCT Pub. Date: Aug. 14, 2003

(65) Prior Publication Data

US 2005/0115222 A1 Jun. 2, 2005

(30) Foreign Application Priority Data

Dec. 6, 2001 (SE) ..... 0104128

(51) Int. Cl.

| | |
|---|---|
| ***F01N 3/10*** | (2006.01) |
| ***F01N 5/04*** | (2006.01) |
| ***F01N 3/00*** | (2006.01) |
| ***F01N 3/02*** | (2006.01) |
| ***F02M 25/06*** | (2006.01) |

(52) U.S. Cl. ..... 60/302; 60/278; 60/295; 60/311; 60/280

(58) Field of Classification Search ..... 60/278, 60/279

See application file for complete search history.

(56) References Cited

U.S. PATENT DOCUMENTS

| | | | | |
|---|---|---|---|---|
| 3,412,722 | A * | 11/1968 | Epifanio, Sr. | 60/278 |
| 3,733,827 | A * | 5/1973 | Suzuki | 60/278 |
| 3,877,447 | A * | 4/1975 | Ross, Sr. | 60/278 |
| 4,356,806 | A * | 11/1982 | Freesh | 123/568.12 |
| 4,364,761 | A * | 12/1982 | Berg et al. | 55/523 |
| 4,902,487 | A | 2/1990 | Cooper et al. | |
| 4,924,668 | A * | 5/1990 | Panten et al. | 60/278 |
| 5,067,320 | A * | 11/1991 | Kanesaki | 60/297 |
| 5,592,925 | A | 1/1997 | Machida et al. | |
| 5,863,311 | A * | 1/1999 | Nagai et al. | 55/483 |
| 6,625,978 | B1 * | 9/2003 | Eriksson et al. | 60/311 |
| 6,736,881 | B1 * | 5/2004 | Leibold et al. | 95/280 |

FOREIGN PATENT DOCUMENTS

| | | |
|---|---|---|
| DE | 101 13 449 | 9/2001 |
| EP | 0010384 A1 * | 4/1979 |
| EP | 1069286 | 1/2001 |
| WO | 99/09307 | 2/1999 |

* cited by examiner

*Primary Examiner*—Thomas Denion
*Assistant Examiner*—Loren Edwards
(74) *Attorney, Agent, or Firm*—Dilworth & Barrese LLP

(57) ABSTRACT

A device for purifying exhaust gases from a combustion engine (1) is provided with a first filter (10) arranged in an exhaust conduit (7) between the engine (1) and an exhaust outlet (8) for removing particular constituents from the exhaust gases, and a recirculation conduit (11) for diverting a part of the exhaust gases passing through the first filter (10) recirculating this part of the exhaust gases to the air intake (2) of the engine. A second filter (30) is arranged between the inlet end (20) of the recirculation conduit and the air intake (2) of the engine. A method for purifying exhaust gases from the combustion engine (1) and using this device to purify exhaust gas, in particular, from a diesel engine, are also provided.

20 Claims, 1 Drawing Sheet

DEVICE FOR EXHAUST GAS PURIFICATION

FIELD OF THE INVENTION

The present invention relates to a device and a method for purifying exhaust gases from a combustion engine, the exhaust gases from the engine being passed through a filter arranged in an exhaust conduit between the engine and an exhaust outlet for removing particulate constituents from the exhaust gases and a part of the exhaust gases that have been passed through said filter being diverted through a recirculation conduit and recirculated to the air intake of the engine. Furthermore, the invention relates to the use of the device for exhaust gas purification in particular at a diesel engine.

PRIOR ART

It is known that EGR (Exhaust Gas Recirculation) is an advantageous purification method for reducing the proportion of hazardous exhaust gases, in particular nitrogen oxide ($NO_x$). In an EGR-system, a part of the exhaust gases from the engine is recirculated to the air intake thereof.

In particular with diesel engines, there exists the problem that a substantial amount of particulate constituents is generated. The expression particulate constituents includes particles as such, e.g. soot, as well as organic residues (denominated SOF) emanating from fuel and oil. It is known to use filters of various types for removing such particulate constituents from exhaust gases. So as to prevent the engine from being damaged by the particulate constituents of the part of the exhaust gases from the engine that is recirculated to the air intake of the engine through a recirculation conduit included in an EGR-system, it is suitable to make this part of the exhaust gases pass through a particle filter before it is recirculated to the engine. This may for instance take place in that the inlet end of the recirculation conduit is arranged downstream of a filter arranged in the exhaust conduit, as shown for instance in DE 4007516 C2. Another alternative is to arrange a filter directly in the recirculation conduit, as shown for instance in U.S. Pat. No. 5,592,925 A. A disadvantage with these known solutions is that a breakdown of the filter may result in that unfiltered or insufficiently filtered exhaust gases are recirculated to the air intake of the engine through the recirculation conduit, which in its turn may result in a costly engine breakdown. A way of preventing unfiltered or insufficiently filtered exhaust gases from being recirculated to the air intake of the engine is to arrange some kind of sensor in the exhaust gas flow downstream of the filter in order to detect the amount of particles in this exhaust gas flow. When it has been registered by the sensor that the amount of particles in the recirculated exhaust gases exceeds a certain limit value, the exhaust gas recirculation is interrupted so that no unfiltered or insufficiently filtered exhaust gases are recirculated to the air intake of the engine. This solution requires the installation of complex electronics and is therefor relatively complicated and costly to implement.

Furthermore, this solution is sensitive to disturbances in the electronic components.

OBJECT OF THE INVENTION

The object of the present invention is to develop the prior art for the purpose of achieving a reliable and simple securance that unfiltered or insufficiently filtered exhaust gases will not be recirculated to the air intake of an engine provided with an EGR-system.

SUMMARY OF THE INVENTION

According to the invention, said object is achieved by a device and method described herein.

The inventive solution implies that the exhaust gases from the engine pass through a first filter arranged in an exhaust conduit between the motor and an exhaust outlet for removing particulate constituents from the exhaust gases, a part of the exhaust gasses that have passed through said first filter being diverted through a recirculation conduit and recirculated to the air intake of the engine, and that the diverted part of the exhaust gases passes through a second filter arranged between the inlet end of the recirculation conduit and the air intake of the engine. Hereby, a redundant filtering system is obtained. When the engine operates normally, under the emission of normal amounts of exhaust gases, and both filters are intact, the first filter arranged in the exhaust conduit catches particulate constituents to such an extent that the exhaust gases, when they have passed through the first filter, are sufficiently filtered for being recirculated to the air intake of the engine without causing any damages to the engine. In case of a functional disorder of the first filter, for instance caused by destruction through external mechanical influence in the form of hits or impacts against the filter, implying a filtering of the exhaust gases that have passed through the first filter being insufficient with respect to the recirculation, the recirculated exhaust gases will be filtered by the second filter so that the air intake of the engine is not reached by any exhaust gases containing particulate constituents that may damage the engine. The second filter also contributes to a sufficient filtering of the recirculated exhaust gases in case the engine, due to a functional disorder, emits exceptionally large amounts of exhaust gases which it is not possible for the first filter to completely take care of. The inventive solution is very cost-effective and has a very high functional reliability.

According to a preferred embodiment of the invention, the second filter is designed with lower or essentially the same filtering efficiency as the first filter so that at least the main part of the particulate constituents in the exhaust gases that are not caught during a passage through the first filter under normal operating conditions neither will be caught during a passage through the second filter. Hereby, it is secured that the second filter under normal conditions will not, or at least not to any appreciable extent, contribute in catching particulate constituents of the recirculated exhaust gases, whereby clogging of the second filter is prevented. Consequently, the second filter will only contribute in reducing the content of particulate constituents of the recirculated exhaust gases in case the first filter is not functioning normally and allows unfiltered or insufficiently filtered exhaust gases to pass through.

According to a further preferred embodiment of the invention, the second filter is arranged at the outlet end of the recirculation conduit. Hereby, air containing particulate constituents of engine-damaging nature is prevented from being sucked into the engine in case of a breakage in the recirculation conduit. The exhaust gas recirculation normally operates through suction effect, the exhaust gases to be recirculated to the air intake of the engine being carried into the recirculation conduit from the exhaust conduit by means of suction effect. In case of a breakage in the recirculation conduit, ambient air will be sucked into the recirculation conduit. This ambient air may carry gravel and other engine-damaging particles with it. By the location of the second filter at the outlet end of the recirculation conduit, such particles sucked in with the ambient air through the recirculation conduit are prevented from reaching the air intake of the engine.

Further preferred embodiments of the inventive device and method will appear from the subsequent description.

The invention also relates to the use of the inventive device.

BRIEF DESCRIPTION OF THE DRAWING

The invention will in the following be more closely described by means of embodiment examples, with reference to the appended drawing.

It is shown in.

DETAILED DESCRIPTION OF PREFERRED EMBODIMENTS

Figure 1:
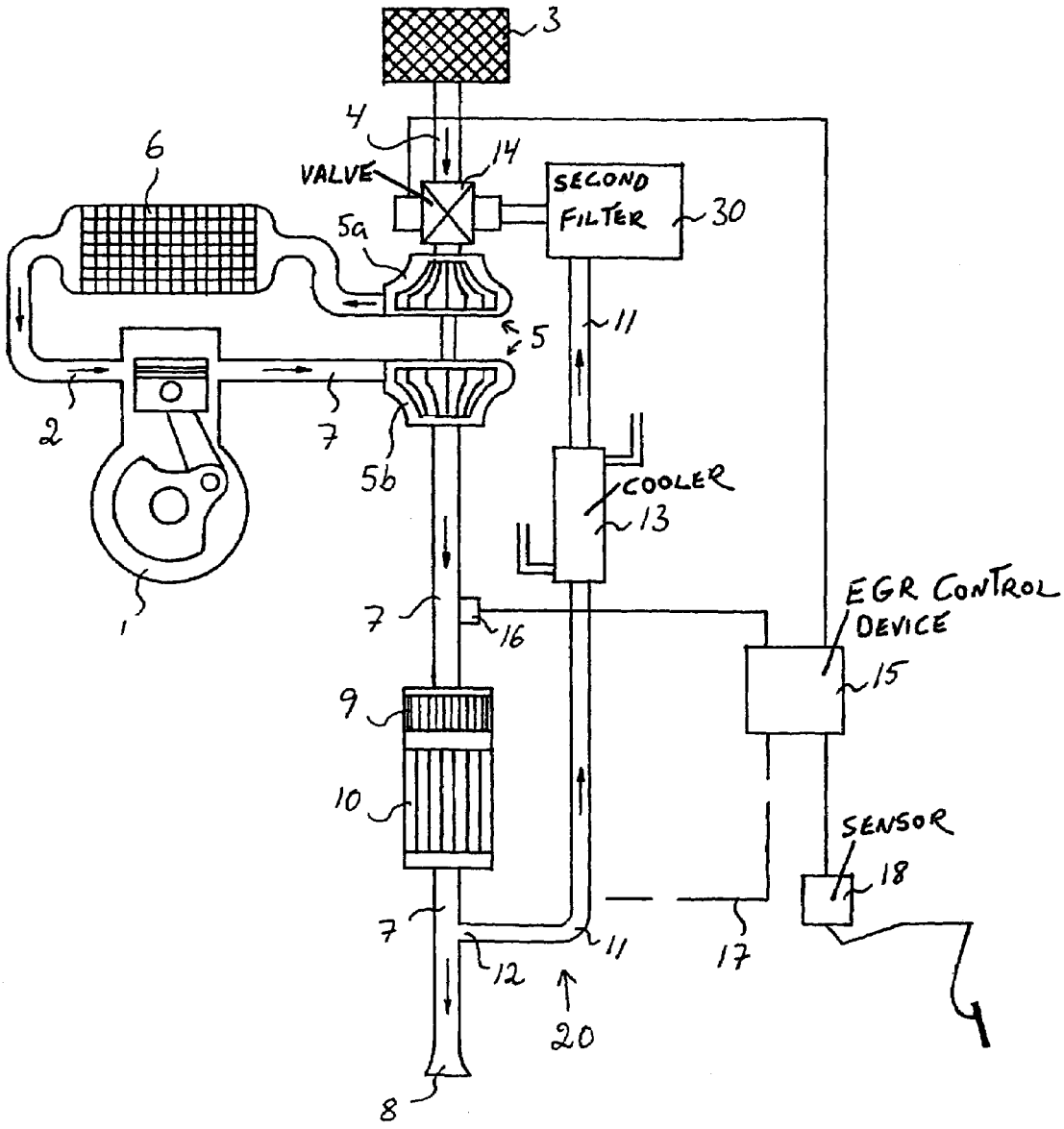
FIG. 1 a principle drawing showing a combustion engine with an associated EGR-system, illustrating an embodiment of the inventive device.

FIG. 1 schematically illustrates a combustion engine provided with a device according to the invention. The combustion engine is schematically indicated at 1. Air is taken to the engine via an air intake 2, adjacent to which an air filter 3 may be provided. The air is directed through an inlet air channel, generally denoted 4, towards the combustion chambers of the engine. It is already here pointed out that the present invention is applicable to engines operating by suction only, i.e. where the air transport into the combustion chamber of the engine is generated by suction due to piston movements in the engine. However, the invention is also applicable to super charging, i.e. forced air supply to the engine, which generally can be accomplished by means of a compressor. Such a compressor may be driven in an arbitrary manner, e.g. mechanically via the engine or suitable auxiliary equipment, or as indicated in FIG. 1, by means of the exhaust gas flow from the engine. Thus, the device comprises in the example a turbo charger 5, which comprises a compressor wheel 5*a* for feeding the air to the engine with over-pressure and a turbine wheel 5*b* placed so as to be but into rotation by actuation of exhaust gases leaving the engine. The compressor wheel 5*a* and the turbine wheel 5*b* are operationally coupled to each other, e.g. by being placed on one and the same shaft. As is usual in super charging, the air may, after having been imparted to overpressure, be subjected to cooling in a charging air cooler 6 (intercooler). The exhaust gases exiting the engine move in an exhaust conduit 7 and enter into the surroundings via an exhaust gas outlet 8. In FIG. 1, it is illustrated how the exhaust gases are directed through a catalyst 9 and a filter 10 before they enter into the surroundings via the exhaust gas outlet 8. Said filter 10, which in the following is denominated the first filter, is adapted to remove particulate constituents from the exhaust gases.

The first filter 10 is to have such a filtering efficiency that it is capable of catching particulate constituents to such an extent that the exhaust gases, after having passed through the first filter 10, are sufficiently filtered for being recirculated to the air intake 2 of the engine and introduced into the engine 1 without causing any damages to the engine.

As will be described in more detail in the following, the inventive device comprises an arrangement, generally denoted with 20, for recirculating exhaust gases from the engine to the air intake 2 of the engine. For this purpose, the device comprises a recirculation conduit, denoted 11, which in the example connects to the inlet air channel 4. The inlet 12 of the recirculation conduit is arranged downstream of the first filter 10, which is arranged in the exhaust conduit. If required, the recirculation conduit 11 may pass through a cooler 13 so as to cool down the recirculated exhaust gases. The recirculation conduit 11 may be connected to the inlet air channel 4 via a valve device 14, which is controllable by means of an EGR-control device 15. The valve device 14 may, with the aid of the EGR-control device 15, regulate the relation between the supplied amount of fresh air from the inlet air channel 4 and the supplied amount of recirculated exhaust gases from the recirculation conduit 11. This mixture adjusted by means of the valve 14 may, accordingly, be supplied to the air intake 2 of the engine.

The EGR-control device 15, which controls the valve device 14, may for instance be supplied with information about the actual state of operation of the engine from i.a. an oxygen measuring probe (lambda probe) 16, a sensor 17 for engine speed and a sensor 18 for throttle position. The EGR-control device 15 is programmed to control the valve device 14 and thereby the mixing relation fresh air/exhaust gases for the purpose of minimising the contents of hazardous substances leaving the exhaust gas outlet 8 and being released into the free air. The programming of the EGR-control device 15 is carried out in a manner known per se to achieve a favourable relation between the various factors mentioned above.

In addition to said first filter 10, the inventive device also comprises a second filter 30. This second filter 30 is arranged between the inlet end 12 of the recirculation conduit and the air intake 2 of the engine, and suitably in or directly adjacent to the recirculation conduit 11. The second filter 30 is preferably arranged at the outlet end of the recirculation conduit, as illustrated in FIG. 1.

The second filter 30 is to have such a filtering efficiency that it is capable of catching particulate constituents to such an extent that gases passing through the second filter 30 can be directed further to the air intake 2 of the engine and introduced into the engine 1 without causing any damages to the engine. The second filter 30 suitably has essentially the same filtering efficiency as a conventional air filter intended for the engine, i.e. in the example shown essentially the same filtering efficiency as the air filter 3.

The second filter 30 is preferably designed with lower or essentially the same filtering efficiency as the first filter 10 so that at least the main part of the particulate constituents in the exhaust gases that are not caught during a passage through the first filter 10 under normal operating conditions neither will be caught during a passage through the second filter 30. Consequently, the second filter is so designed that it will not catch or only to a very small extent will catch particulate constituents of the exhaust gases that are passing through the second filter 30 after first having passed through the first filter 10 under operating conditions with normal amounts of exhaust gases from the engine and when the first filter is intact. Under such normal conditions, the second filter will consequently function as a component being passive or essentially passive with respect to particle filtration. The second filter 30 is only intended to function as an active filtering component at occasions when the content of particulate constituents in the gases passing through the second filter 30 is larger than normally, so as to protect the engine against particulate constituents of engine-damaging nature at such occasions. In order to achieve the abovementioned mutual relation between the filtering efficiency of the first filter 10 and the second filter 30, the second filter 30 may have a nominal filtering grade that is lower than or essentially equal to the nominal filtering grade of the first filter 10. As an alternative or in combination thereto, the second filter 30 may have an absolute filtering grade that is lower than or essentially equal to the absolute filtering grade of the first filter 10.

The expression "nominal filtering grade" here refers to a micron-value attributed to a filter by a filter manufacturer in order to specify the filtering efficiency of the filter. The second filter 30 may for instance have a nominal filtering grade expressed as 99% removal efficiency at 10 micron, which implies that the filter is to be capable of filtering away 99% of particles being larger than 10 micrometer that are passing by. According to this example, the first filter 10 should consequently have a nominal filtering grade corresponding to or being higher than 99% removal efficiency at 10 micron.

The "absolute filtering grade" of a filter refers to a value indicating the diameter of the largest hard spherical particle that is able to pass through the filter under specified testing conditions. Also this value may be attributed to a filter by a filter manufacturer in order to specify the filtering efficiency of the filter. The second filter 30 may for instance have an absolute filtering grade expressed as 10 micron, which implies that the filter is to be capable of filtering away all particles larger than 10 micrometer that are passing by. According to this example, the first filter 10 should consequently have an absolute filtering grade corresponding to or being higher than 10 micron.

The first filter 10 and the second filter 30 comprise a filter material being resistant to high temperatures and having a good filtrating ability. As an example it may be mentioned that ceramic materials, mineral fibres and metallic fibres may be used.

The first filter 10 is suitably designed as a regenerating filter, i.e. a filter that may be restored without exchange. Such regeneration may for instance, in known manner, be achieved by heating the filter to a required degree for the combustion of the particulate constituents deposited on the filter to occur. Another possible technique for achieving regeneration of the filter 10 in question is described in the patent document U.S. Pat. No. 4,902,487 A. According to this technique, a catalyst upstream of the filter is used, which catalyst is capable of converting a part of the NO naturally present in the exhaust gases into $NO_2$, which then reacts with the particulate constituents deposited on the filter. This gives rise to an automatic regeneration of the filter. Since the second filter 30 under normal conditions does not contribute or at least not to any appreciable extent contributes to the removal of particulate constituents from the passing exhaust gases, this filter 30 does not have to be designed as a regenerating filter. If considered suitable, also the second filter 30 can, however, of course be designed as a regenerating filter.

As an alternative to the embodiment of the invention illustrated in FIG. 1 with a catalyst 9 arranged upstream of the first filter, the first filter 10 could comprise a catalytic material capable of transferring constituents in the exhaust gases into less environmentally hazardous substances. In this case, the catalytic material would consequently be integrated in the filter 10, preferably in the form of a coating on the filter material included in the filter. The inventive device may of course also be designed completely without any catalyst function.

The invention is especially advantageous with diesel engines and particularly with diesel engines of super charged type. It is however emphasised that the invention also can be used with other types of engines. Furthermore, the invention works irrespective of the engine being super charged or not, i.e. if the air supply to the engine is forced or generated by suction due to piston movements in the engine. If the engine in question would be super charged, the exhaust gas recirculation conduit should be connected to the air inlet channel on the suction side of the super charging unit, as illustrated in FIG. 1.

It is emphasised that the inventive device could be applied to the engine already in connection with the manufacturing thereof, but it is also possible to apply the device afterwards to an already used engine in order to add or improve the EGR-function.

The invention is of course not in any way restricted to the preferred embodiments described above, on the contrary many possibilities to modifications thereof should be apparent to a person skilled in the art without departing from the basic idea of the invention as defined in the appended claims.

The invention claimed is:

1. A device for purifying exhaust gases from a combustion engine (1), comprising a first filter (10) arranged in an exhaust conduit (7) between the engine (1) and an exhaust outlet (8) for removing particulate constituents from the exhaust gases, a recirculation conduit (11) branching off the exhaust conduit (7) downstream of the first filter (10) and upstream of the exhaust outlet (8) for diverting a part of the exhaust gases that have passed through said first filter (10) and recirculating this part of the exhaust gases to the air intake (2) of the engine (1), a second filter (30) arranged downstream of an inlet end (12) of the recirculation conduit (11) from the exhaust gas conduit (7) and between the inlet end (12) and air intake (2) of the engine (1), and having a lower nominal filtering grade than said first filter (10), and said exhaust conduit (7), recirculation conduit (11) and first and second filters (10, 30) arranged such that gas flow occurs in only one direction through said exhaust conduit (7) and first filter (10), and then through said recirculation conduit (11) and second filter (30).

2. A device according to claim 1, wherein the second filter (30) is designed with lower or essentially the same filtering efficiency as the first filter (10).

3. A device according to claim 2, wherein the second filter (30) has such a filtering efficiency that is capable of catching particulate constituents of engine-damaging nature.

4. A device according to claim 3, wherein the second filter (30) has essentially the same filtering efficiency as a conventional air filter intended for the engine (1).

5. A device according to claim 1, wherein the second filter (30) has such a filtering efficiency that is capable of catching particulate constituents of engine-damaging nature.

6. A device according to claim 5, wherein the second filter (30) has essentially the same filtering efficiency as a conventional air filter intended for the engine (1).

7. A device according to claim 1, wherein the second filter (30) is arranged in the outlet end of the recirculation conduit (11).

8. A device according to claim 1, wherein the first filter (10) comprises a catalytic material for transferring constituents in the exhaust gases into less environmentally hazardous substances.

9. A device according to claim 1, wherein the device comprises a catalyst (9) arranged in the exhaust conduit (7).

10. A device according to claim 1, structured and arranged for purifying exhaust gases from a diesel engine.

11. A device according to claim 1, wherein the nominal filtering grade is a measure of per cent removal of particulates of a particular size.

12. A device according to claim 1, additionally comprising a cooler (13) located in said recirculation conduit (11), with said second filter (30) located downstream of said cooler (13) and within said recirculation conduit (11).

13. A device according to claim 1, additionally comprising an air inlet channel (4) coupled to the air intake (2) of the engine (1), a valve (14) arranged to join an outlet end of the recirculation conduit (11) with the air inlet channel (4), and an EGR-control device (15) structured and arranged to control the valve (14) to regulate ratio of fresh air suppled through the air inlet channel (4) to recirculated exhaust gases through the recirculation conduit (11).

14. A device according to claim 13, wherein the EGR-control device (15) additionally comprises a probe (16) arranged for measuring oxygen in the exhaust conduit (7), a sensor (17) arranged for measuring engine speed, and a sensor (18) arranged for detecting throttle position.

15. A device according to claim 14, additionally comprising an air cooler (6) situated in the air intake (2), and a turbo charger (5) comprising a compressor wheel (5*a*) situated to feed air with over-pressure along the air intake (2) to the engine (1), and a turbine wheel (5*b*) coupled to said compressor wheel (5*a*) and arranged to be rotated by the exhaust gases leaving the engine (1) along the exhaust conduit (7).

16. A device according to claim 15, additionally comprising a catalyst (9) situated upstream of said first filter (10) in said exhaust conduit (7).

17. A method for purifying exhaust gases from a combustion engine (1), comprising the steps of passing the exhaust gases in a single direction from the engine (1) through a first filter (10) arranged in an exhaust conduit (7) between the engine (1) and an exhaust outlet (8) for removing particulate constituents from the exhaust gases, diverting a part of the exhaust gases that have passed through said first filter (10) and prior to passing through said exhaust outlet (8), through a recirculation conduit (11) in a single direction to be recirculated to an air intake (2) of the engine (1), and passing the diverted part of the exhaust gases through a second filter (30) having a lower nominal filtering grade than said first filter (10) and arranged downstream of an inlet end (12) of the recirculation conduit (11) from the exhaust gas conduit (7) and between the inlet end (12) and air intake (2) of the engine (1).

18. A method according to claim 17, wherein the nominal filtering grade is a measure of per cent removal of particulates of a particular size.

19. A method according to claim 17, comprising the additional step of purifying exhaust gases from a diesel engine.

20. A method according to claim 17, comprising the additional step of cooling the diverted part of the exhaust gases in the recirculation conduit (11) by passing through a cooler (13) prior to passing through said second filter (30) situated within said recirculation conduit (11).

* * * * *